US011766593B1

(12) United States Patent
Hebreo et al.

(10) Patent No.: US 11,766,593 B1
(45) Date of Patent: Sep. 26, 2023

(54) ADJUSTABLE BOUNCE WEDGE

(71) Applicant: Acushnet Company, Fairhaven, MA (US)

(72) Inventors: Jonathan Hebreo, San Diego, CA (US); Richard L. Cleghorn, Oceanside, CA (US); Doug M. Takehara, Oceanside, CA (US); Aaron Dill, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/706,436

(22) Filed: Mar. 28, 2022

(51) Int. Cl.
*A63B 53/04* (2015.01)
*A63B 53/06* (2015.01)
*A63B 53/08* (2015.01)

(52) U.S. Cl.
CPC ..... *A63B 53/06* (2013.01); *A63B 53/047* (2013.01); *A63B 53/0433* (2020.08); *A63B 53/08* (2013.01); *A63B 2053/0479* (2013.01)

(58) Field of Classification Search
CPC ... A63B 53/06; A63B 53/0433; A63B 53/047; A63B 2053/0479
See application file for complete search history.

(56) References Cited

U.S. PATENT DOCUMENTS 645,944 A 3/1900 Dalgleish
4,671,513 A 6/1987 Swanson
6,471,601 B1 10/2002 McCabe
7,393,286 B1 7/2008 Renegar
7,588,503 B2 * 9/2009 Roach ..... A63B 53/047 473/332
8,033,931 B2 * 10/2011 Wahl ..... A63B 53/047 473/350
8,777,774 B1 * 7/2014 Kim ..... A63B 60/02 473/335
8,821,307 B2 * 9/2014 Park ..... A63B 53/04 473/244
9,033,814 B2 * 5/2015 Stites ..... A63B 53/047 473/324
9,669,272 B2 * 6/2017 Park ..... A63B 53/04
9,987,532 B2 * 6/2018 Sander ..... A63B 53/06
10,137,341 B2 * 11/2018 Greer ..... A63B 53/06
11,013,970 B1 * 5/2021 Roach ..... A63B 53/047
11,027,175 B2 * 6/2021 Sizemore, Jr. ..... A63B 60/02
2006/0194641 A1 * 8/2006 Best ..... A63B 60/02 473/332
2013/0165251 A1 * 6/2013 Jorgensen ..... A63B 53/047 473/328
2013/0324276 A1 * 12/2013 Stites ..... A63B 53/047 473/324

(Continued)

*Primary Examiner* — William M Pierce
(74) *Attorney, Agent, or Firm* — Ryan A. Reis

(57) ABSTRACT

An iron type golf club head, including a body including a striking face, a topline located at a top of the striking face, a leading edge located at a bottom of the striking face, a body sole surface extending rearward from the leading edge, a hosel located at a heel side of the golf club head, a toe side opposite the heel side, a sole plate rotatably coupled to the body, wherein the sole plate comprises an adjustment member located between the body and the sole plate, wherein the adjustment member is adjustable between a maximum bounce position and a minimum bounce position.

14 Claims, 11 Drawing Sheets

(56) References Cited

U.S. PATENT DOCUMENTS

| | | | | |
|---|---|---|---|---|
| 2013/0324299 | A1* | 12/2013 | Clausen | A63B 53/047<br>473/409 |
| 2017/0095707 | A1* | 4/2017 | Ripp | A63B 53/06 |
| 2017/0095708 | A1* | 4/2017 | Ripp | A63B 53/06 |
| 2021/0331042 | A1* | 10/2021 | Gonzalez | A63B 53/04 |
| 2022/0266103 | A1* | 8/2022 | Gonzalez | A63B 53/08 |

* cited by examiner

ADJUSTABLE BOUNCE WEDGE

TECHNICAL FIELD

This present technology generally relates to systems, devices, and methods related to golf clubs, and more specifically to iron type golf club heads, and more specifically to wedge type golf club heads. More specifically, the present invention relates to a wedge type golf club head with an adjustable bounce sole surface.

DESCRIPTION OF THE RELATED TECHNOLOGY

Iron type golf clubs are generally used by golfers to hit golf shots from the turf, which means they are designed to hit golf shots that lay directly on the grass itself. Given that the sole of these types of golf club heads are the part of the golf club head that has the most surface area to contact the turf, the design of the sole profile often has a significant impact on the quality of the turf interaction.

U.S. Pat. No. 645,944 to Dalgleish illustrates one of the earlier attempts at improving the performance of the golf club by changing the sole profile. Despite the fact that the invention by Dalgleish was directed more of a "brassies" type wood or fiber golf club head, it illustrated an early recognition of the importance of sole interaction with a golf club and a design intended to improve the performance.

In a more modern context, U.S. Pat. No. 4,671,513 to Swanson illustrates "a golf club iron provided with protuberances or knobs on the bottom sole face thereof to minimize 'fat' shots, reduce the size of the divots, and to accommodate tilting of the club head on the turf laterally and in front to rear directions without spoiling the shot."

U.S. Pat. No. 6,471,601 to McCabe et al. provides another illustration wherein the sole of the golf club head is improved for better performance, this time utilizing a crescent surface, a positive bounce surface, a heel surface, and a toe surface.

Different golfers often require different sole profiles to fit their different types of golf swings. The difference in sole profiles becomes more important in iron and wedge type golf club heads that consistently interact with the turf. U.S. Pat. No. 7,393,286 to Renegar illustrates one example of a golf club head that focuses on the sole of a golf club by creating a corrugates sole with one or more V-shaped cutouts in an attempt to make one golf club sole profile fit multiple different types of golf swings. However, most modern day golf club designers recognize that the varying golf swings are so dramatically different; it truly necessitates a different sole design profile depending on the needs of the golfer.

The present invention improves upon the previously mentioned designs by creating an adjustable bounce sole surface.

SUMMARY

The systems, methods, and devices described herein have innovative aspects, no single one of which is indispensable or solely responsible for their desirable attributes. Without limiting the scope of the claims, some of the advantageous features will now be summarized.

One non-limiting embodiment of the present technology includes an iron type golf club head, including a body including a striking face; a topline located at a top of the striking face; a leading edge located at a bottom of the striking face; a body sole surface extending rearward from the leading edge; a hosel located at a heel side of the golf club head; a toe side opposite the heel side; a sole plate rotatably coupled to the body, wherein the sole plate comprises: a cavity area adjacent the body; a sole plate surface opposite the cavity area; an adjustment member located between the body and the sole plate; wherein the adjustment member is at least partially located within the cavity area of the sole plate; wherein the adjustment member is adjustable between a maximum bounce position and a minimum bounce position; wherein a majority of the sole plate is located furthest from the body when the adjustment member is located in the maximum bounce position and the majority of the sole plate is located closest to the body when the adjustment member is located in the minimum bounce position; a plate retention member configured to selectively lock the sole plate to the body in a locked position; wherein the sole plate rotates about a pivot axis; wherein the pivot axis is located adjacent the leading edge; and a pin passing through the body and the sole plate, the pin located along the pivot axis; wherein the sole plate comprises a first abutment surface and a second abutment surface; wherein the adjustment member abuts the first abutment surface when the adjustment member is in the minimum bounce position and the second abutment surface when the adjustment member is in the maximum bounce position; wherein the adjustment member is configured to slide between the maximum bounce position and the minimum bounce position when the plate retention member is in an unlocked position.

An additional non-limiting embodiment of the present technology includes an iron type golf club head, including a body including: a striking face; a topline located at a top of the striking face; a leading edge located at a bottom of the striking face; a body sole surface extending rearward from the leading edge; a hosel located at a heel side of the golf club head; a toe side opposite the heel side; a sole plate rotatably coupled to the body, wherein the sole plate comprises an adjustment member located between the body and the sole plate; wherein the adjustment member is adjustable between a maximum bounce position and a minimum bounce position; wherein a majority of the sole plate is located furthest from the body when the adjustment member is located in the maximum bounce position and the majority of the sole plate is located closest to the body when the adjustment member is located in the minimum bounce position; and a plate retention member configured to selectively lock the sole plate to the body in a locked position; wherein the adjustment member is configured to slide between the maximum bounce position and the minimum bounce position when the plate retention member is in an unlocked position.

In an additional non-limiting embodiment of the present technology the sole plate further comprises a cavity area adjacent the body and a sole plate surface opposite the cavity area, wherein the adjustment member is at least partially located within the cavity area of the sole plate.

In an additional non-limiting embodiment of the present technology the sole plate rotates about a pivot axis, wherein the pivot axis is located adjacent the leading edge.

In an additional non-limiting embodiment of the present technology the sole plate comprises a first abutment surface and a second abutment surface, wherein the adjustment member abuts the first abutment surface when the adjustment member is in the minimum bounce position and the second abutment surface when the adjustment member is in the maximum bounce position.

In an additional non-limiting embodiment of the present technology the plate retention member comprises a threaded body, wherein the body comprises a threaded bore, and wherein rotation of the plate retention member forces the plate retention member between the locked position and the unlocked position, allowing the sole plate to rotate away from the body, allowing the adjustment member to translate between the maximum bounce position and the minimum bounce position.

In an additional non-limiting embodiment of the present technology the adjustment member comprises an adjustment indicator visible from an exterior of the golf club head, the adjustment indicator configured to indicate a position of the adjustment member.

In an additional non-limiting embodiment of the present technology the adjustment member is configured to slide from the heel side towards the toe side of the golf club head.

In an additional non-limiting embodiment of the present technology the body comprises a body locating feature, the adjustment member comprises an adjustment member locating feature, and wherein the body locating feature is configured to slidably engage the adjustment member locating feature.

In an additional non-limiting embodiment of the present technology the body locating feature comprises a rail and the adjustment member locating feature comprises a relief.

In an additional non-limiting embodiment of the present technology including a washer residing between the plate retention member and the sole plate, the washer including a spherical surface, wherein the spherical surface abuts the plate retention member.

An additional non-limiting embodiment of the present technology includes an iron type golf club head, including: a body including:

a striking face; a topline located at a top of the striking face; a leading edge located at a bottom of the striking face; a body sole surface extending rearward from the leading edge; a hosel located at a heel side of the golf club head; a toe side opposite the heel side; a sole plate rotatably coupled to the body, wherein the sole plate comprises an adjustment member located between the body and the sole plate; wherein the adjustment member is adjustable between a maximum bounce position and a minimum bounce position; wherein a majority of the sole plate is located furthest from the body when the adjustment member is located in the maximum bounce position and the majority of the sole plate is located closest to the body when the adjustment member is located in the minimum bounce position; and wherein the sole plate comprises a first abutment surface and a second abutment surface, wherein the adjustment member abuts the first abutment surface when the adjustment member is in the minimum bounce position and the second abutment surface when the adjustment member is in the maximum bounce position.

In an additional non-limiting embodiment of the present technology the sole plate further comprises a cavity area adjacent the body and a sole plate surface opposite the cavity area, wherein the adjustment member is at least partially located within the cavity area of the sole plate.

In an additional non-limiting embodiment of the present technology the sole plate rotates about a pivot axis, wherein the pivot axis is located adjacent the leading edge.

An additional non-limiting embodiment of the present technology includes a plate retention member configured to selectively lock the sole plate to the body in a locked position, and wherein the adjustment member is configured to slide between the maximum bounce position and the minimum bounce position when the plate retention member is in an unlocked position.

In an additional non-limiting embodiment of the present technology the plate retention member comprises a threaded body, wherein the body comprises a threaded bore, and wherein rotation of the plate retention member forces the plate retention member between the locked position and the unlocked position, allowing the sole plate to rotate away from the body, allowing the adjustment member to translate between the maximum bounce position and the minimum bounce position.

In an additional non-limiting embodiment of the present technology the adjustment member comprises an adjustment indicator visible from an exterior of the golf club head, the adjustment indicator configured to indicate a position of the adjustment member.

In an additional non-limiting embodiment of the present technology the body comprises a body locating feature, the adjustment member comprises an adjustment member locating feature, and wherein the body locating feature is configured to slidably engage the adjustment member locating feature.

In an additional non-limiting embodiment of the present technology the body locating feature comprises a rail and the adjustment member locating feature comprises a relief.

An additional non-limiting embodiment of the present technology includes a washer residing between the plate retention member and the sole plate, the washer including a spherical surface, wherein the spherical surface abuts the plate retention member.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
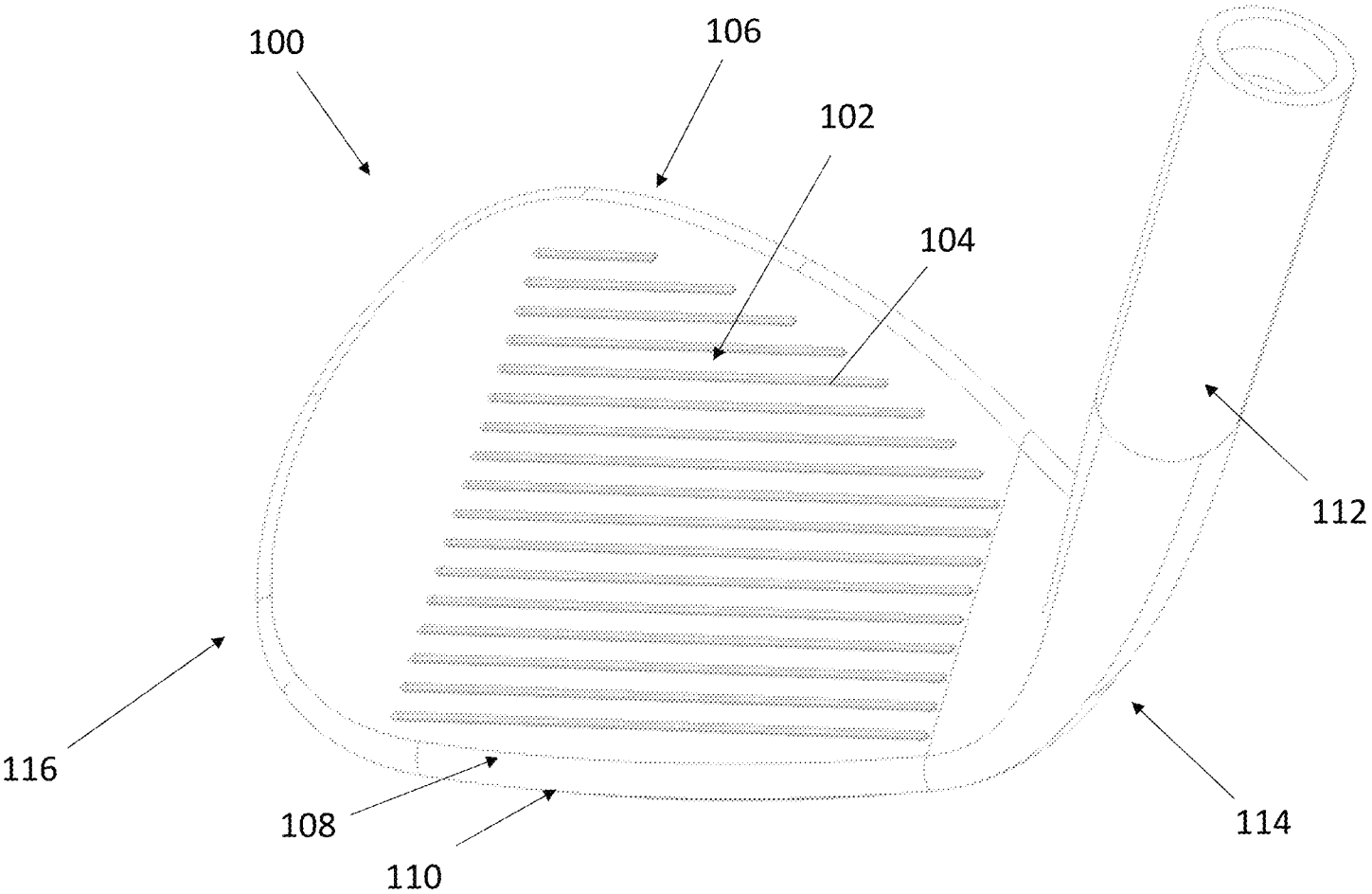
FIG. 1 illustrates a perspective view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to wedge type golf club heads. More specifically, some embodiments relate to wedge type golf club heads having adjustable bounce sole plates.

Figure 2:
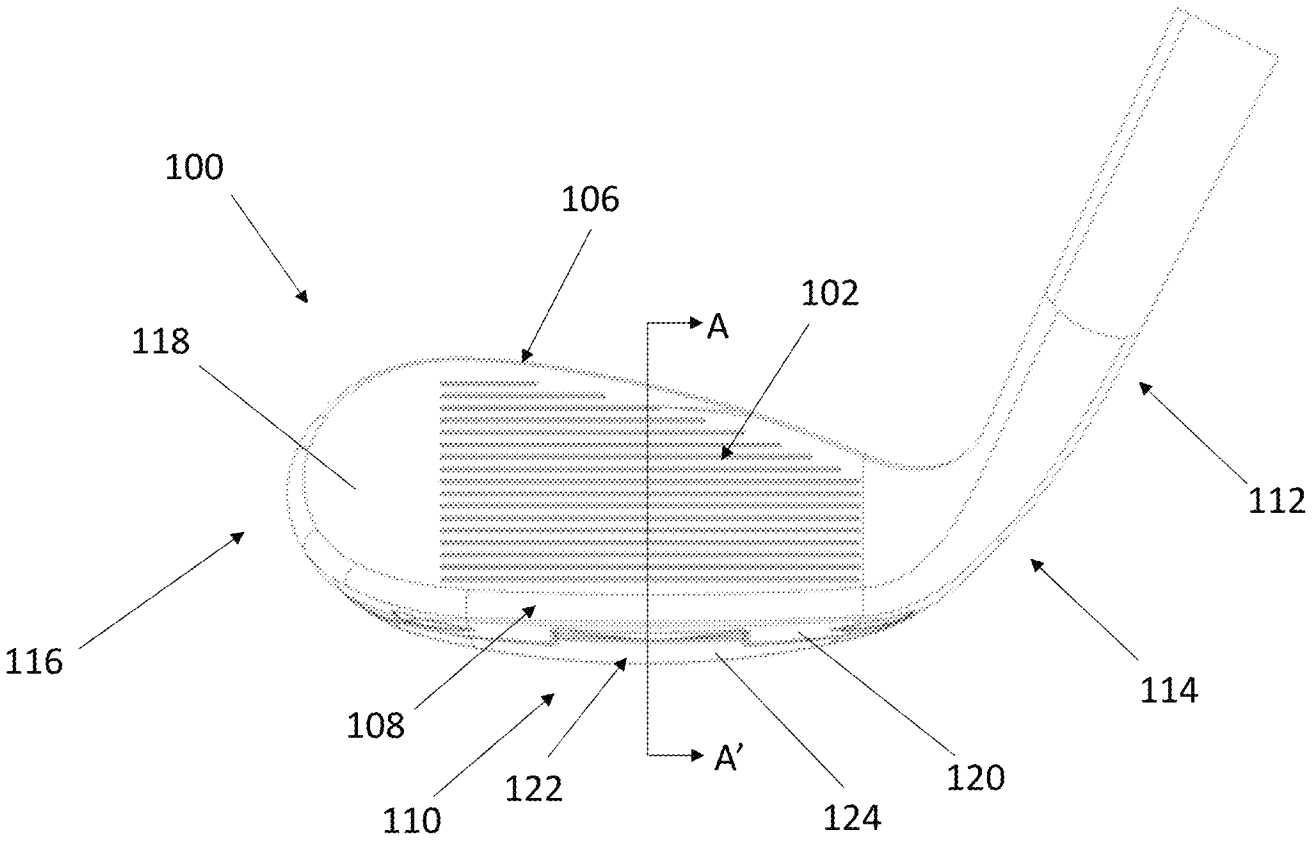
FIG. 2 illustrates a front view of the golf club head of FIG. 1.

FIG. 1 illustrates a perspective view of a golf club head 100. FIG. 2 illustrates a front view of the golf club head 100 of FIG. 1. In a preferred embodiment, the golf club head 100 is an iron type golf club head. In a more preferred embodiment, the golf club head 100 is a wedge type golf club head. The golf club head includes a body 118 having a striking face 102. The striking face 102 is configured to strike a golf ball. The striking face includes scorelines 104 configured to increase the coefficient of friction between the striking face 102 and the golf ball during impact, increasing backspin, which increases the stopping power of the golf ball on the green. The golf club head 100 includes a hosel 112 on a heel side 114. The hosel 112 is configured to receive a golf club shaft (not illustrated). The golf club head 100 includes a toe side 116 opposite the heel side 114. The golf club head includes a topline 106 above the striking face 102 and a sole 110 below the striking face 102. The intersection of the sole 110 and the striking face 102 forms the leading edge 108.

Figure 3:
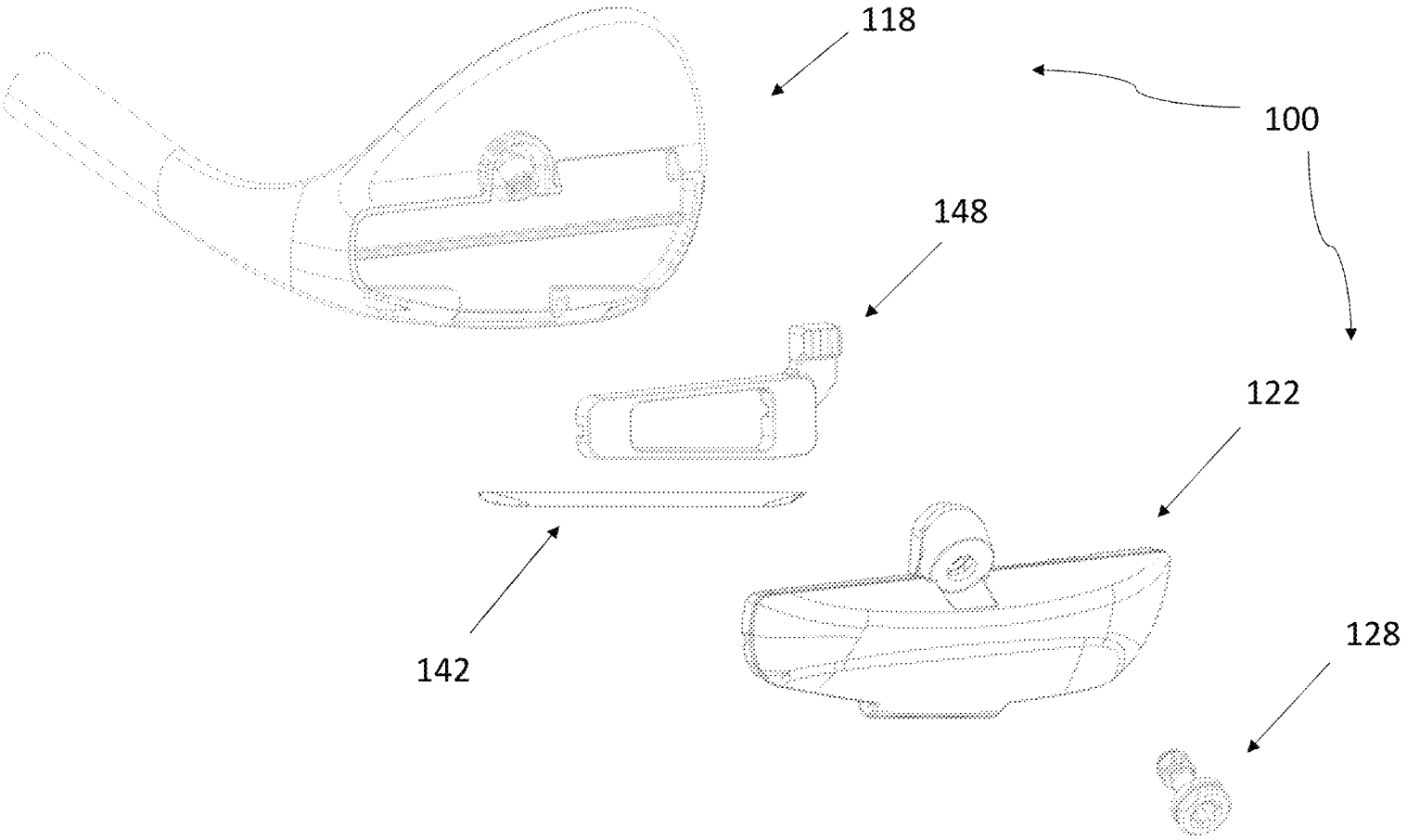
FIG. 3 illustrates and exploded view of the golf club head of FIG. 1.
Figure 4:
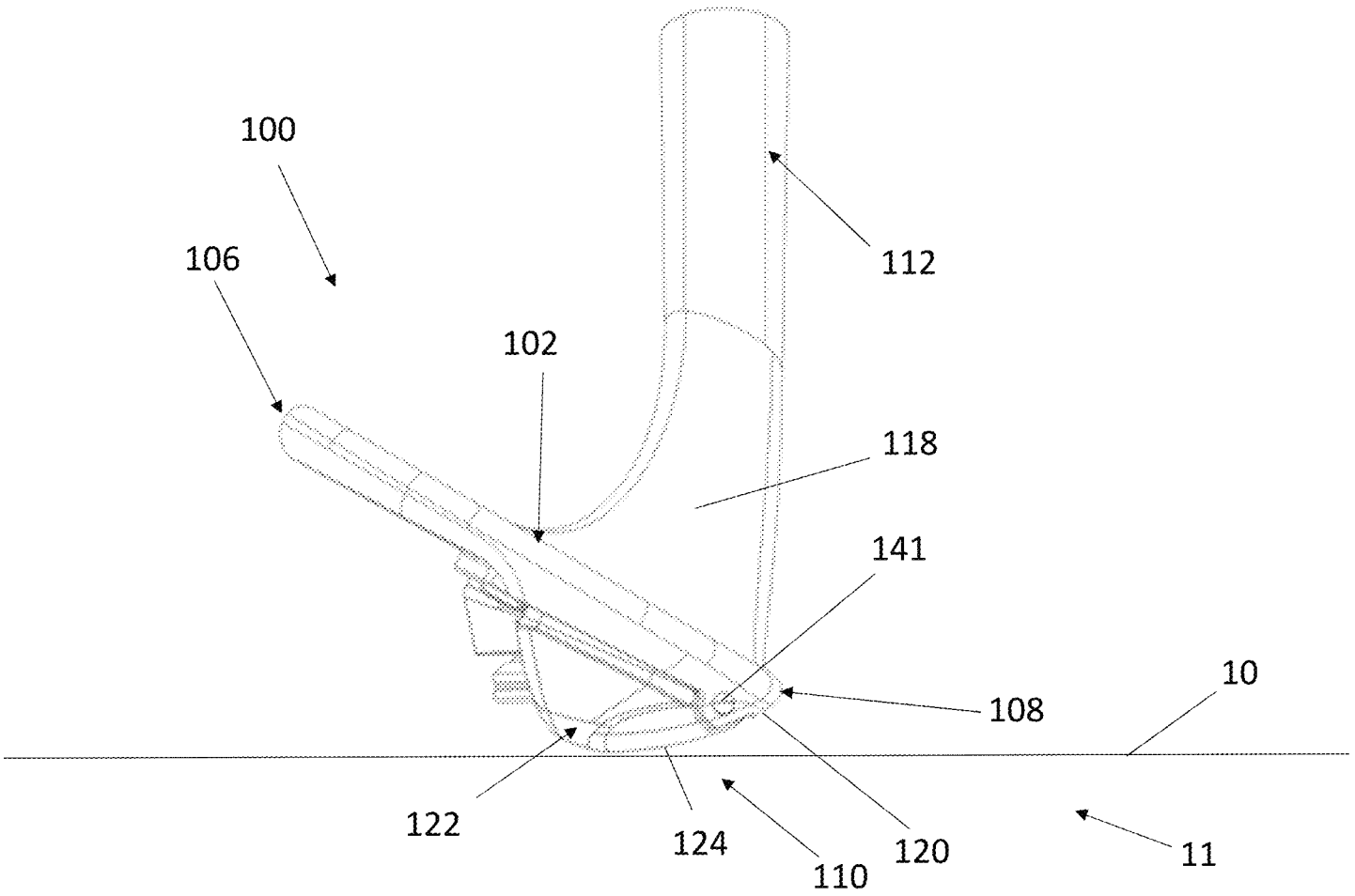
FIG. 4 illustrates a toe-side view of the golf club head of FIG. 1.
Figure 5:
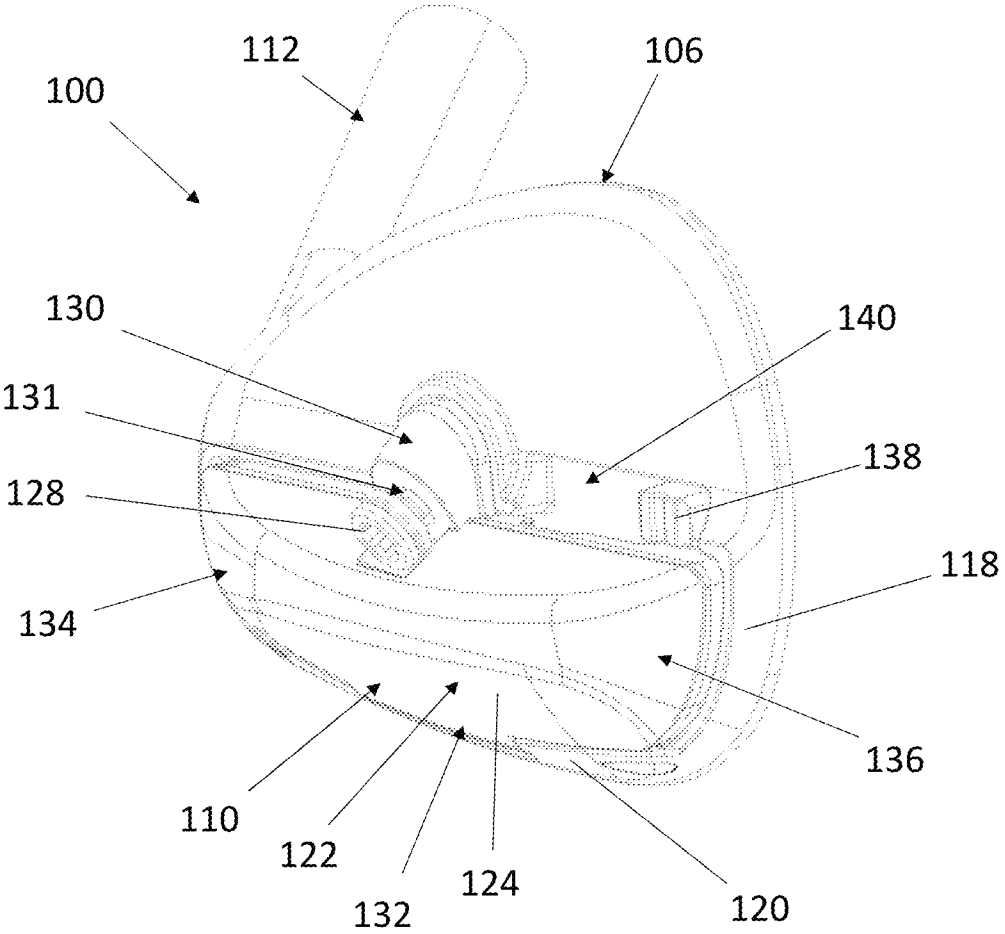
FIG. 5 illustrates an additional perspective view of the golf club head of FIG. 1.
Figure 6:
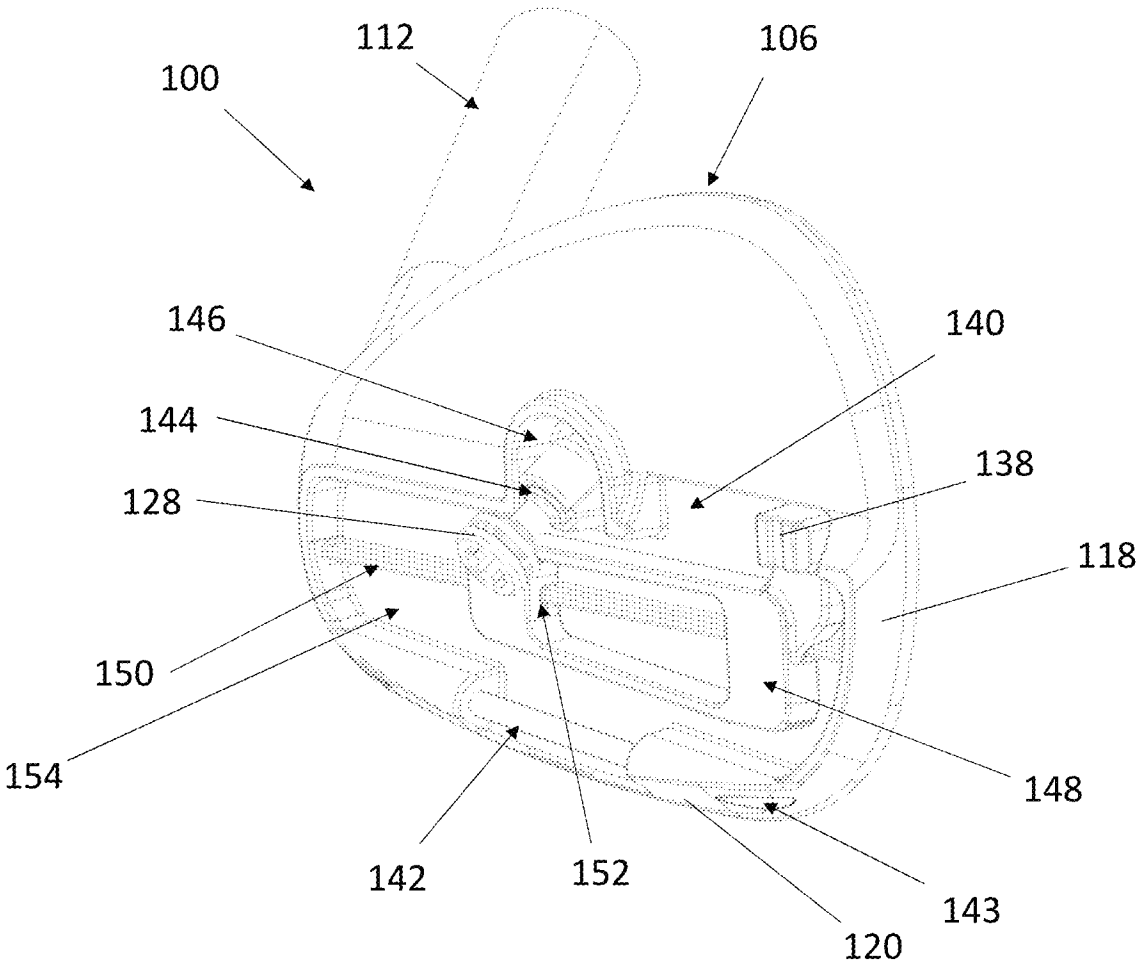
FIG. 6 illustrates the golf club head of FIG. 5 missing the sole plate.
Figure 7:
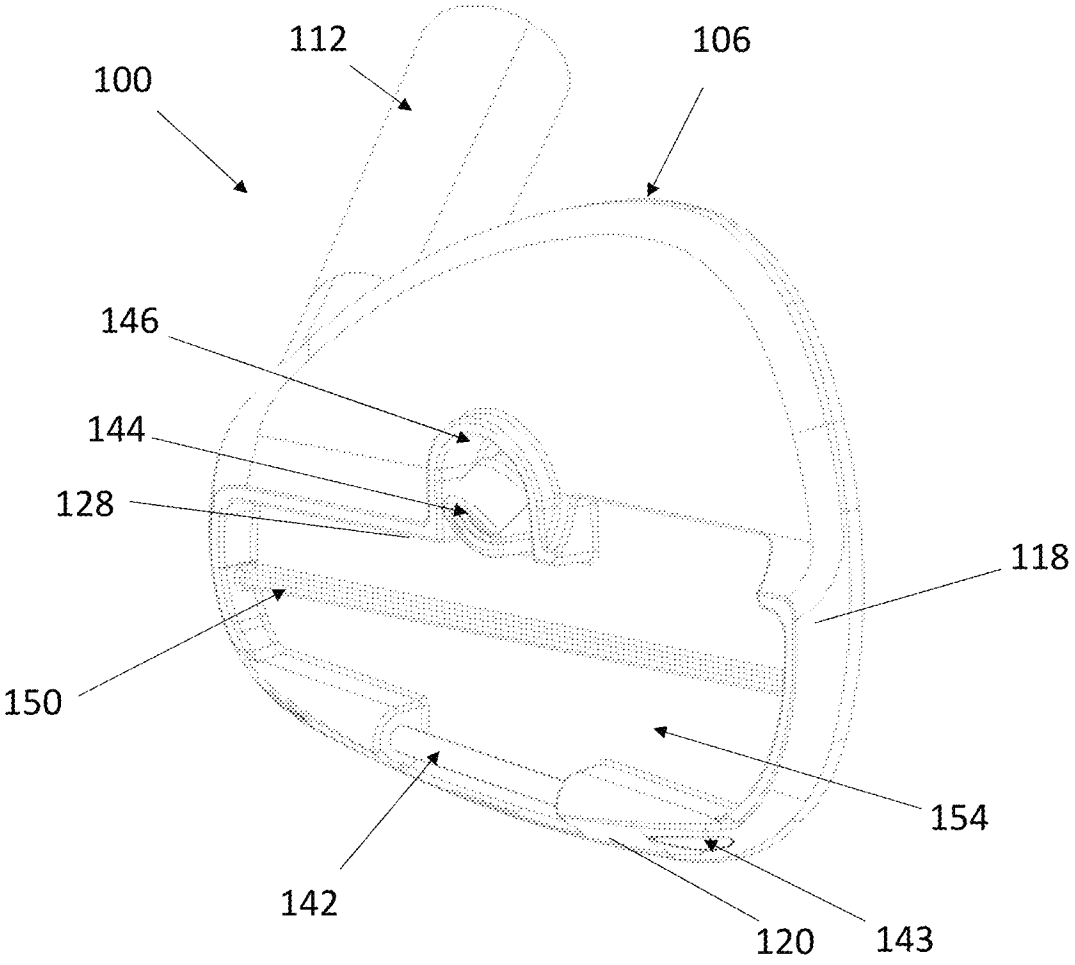
FIG. 7 illustrates the golf club head of FIG. 6 missing the adjustment member.
Figure 8B:
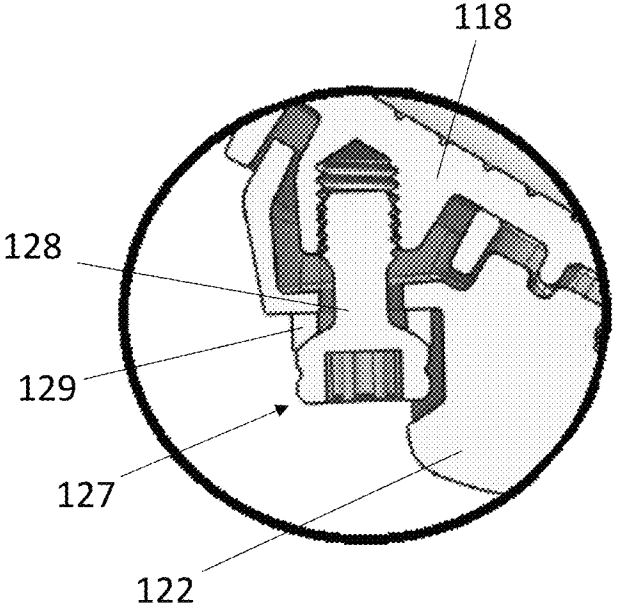
FIG. 8B illustrates a detail view of the cross-sectional view A-A' of the golf club head of FIG. 8A.
Figure 8A:
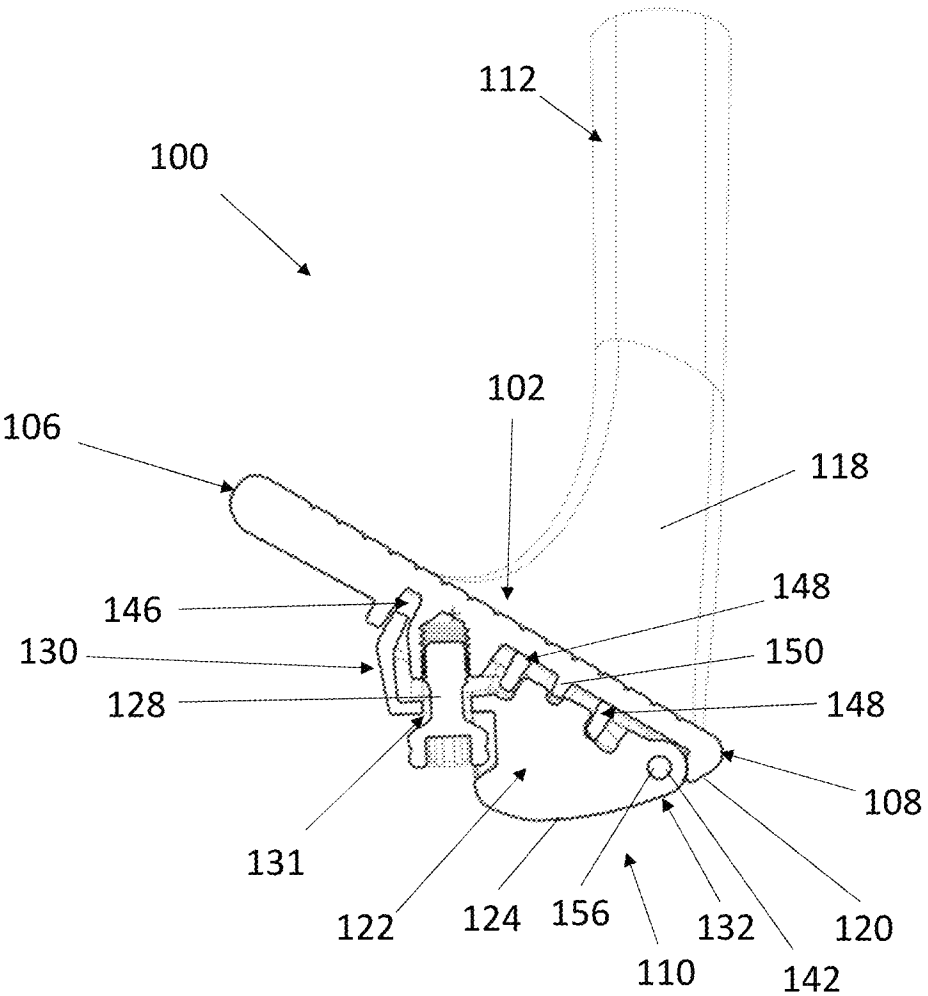
FIG. 8A illustrates a cross-sectional view A-A' of the golf club head of FIG. 2.

FIG. 3 illustrates and exploded view of the golf club head 100 of FIG. 1. FIG. 4 illustrates a toe-side view of the golf club head of FIG. 1. FIG. 5 illustrates an additional perspective view of the golf club head 100 of FIG. 1. FIG. 6 illustrates the golf club head of FIG. 5 missing the sole plate 122. FIG. 7 illustrates the golf club head of FIG. 6 missing the adjustment member 148. FIG. 8A illustrates a cross-sectional view A-A' of the golf club head 100 of FIG. 2. FIG. 8B illustrates a detail view of the cross-sectional view A-A' of the golf club head 100 of FIG. 8A.

The sole 110 of the golf club head 100 includes a body sole surface 120 adjacent the leading edge 108. The golf club head 100 also includes an adjustable sole plate 122. The sole plate 122 includes a sole plate surface 124. The sole plate surface 124 abuts the body sole surface 120 and extends aft away from the leading edge 108. The body sole surface 120 and the sole plate surface 124 form the sole 110 of the golf club head 100.

As illustrated in FIG. 4, the golf club head 100 is shown at address wherein the golf club head 100 is sitting upon the ground plane 10 at prescribed loft and lie. The hosel is aligned parallel to a plane which is perpendicular to the ground plane 10 and extending heel to toe across the striking face 102 such that the golf club shaft (not illustrated) is not inclined forward or rearward. The geometry of the sole 110 relative to the ground plane 10 at address changes the way the golf club head 100 interacts with the turf 11 during the swing. Traditionally, the swing of a wedge type golf club head delivers the golf club head into the turf 11 and below the ground plane 10 prior to impacting a golf ball. The angle of the sole 110 relative to the ground plane 10 changes the amount of effective bounce of the golf club head, which is the tendency of the golf club head to resist passing through the ground plane 10 into the turf 11. The preferred amount of effective bounce depends on the player's swing and turf conditions. Too little effective bounce for the player's swing and turf conditions and the golf club head 100 can dig into the turf 11, resulting in a large reduction in club head speed prior to impacting the golf ball. Too much effective bounce for the player's swing and turf conditions and the golf club may not penetrate far enough into the turf and the leading edge can strike the golf ball, leading to unpredictable ball flight.

The inventive golf club head 100 described herein, provides for adjustment of the sole plate 122 and the sole plate surface 124 relative to body 118 of the golf club head and thus the ground plane 10 when in an address position, therefore adjusting the effective bounce of the golf club head 100. This allows a golfer to dial in the amount of effective bounce necessary for the turf conditions they are playing that particular day. The sole plate 122 is configured to pivot relative to the body 118 of the golf club head 100 around a pivot axis 141. The pivot axis 141 is preferably located aft of and adjacent to the leading edge 108. The sole plate 122 can rotate about a pin 142. The body 118 of the golf club head can include a pin receptacle 143 configured to accept and retain the pin 142. The sole plate 122 can include a pin aperture 156 configured to rotatably receive the pin 142. The pin aperture 156 can be formed through a plate lower portion 132. In another embodiment, not illustrated, rather than being rotatably coupled via a pin, the sole plate can be rotatably coupled to the body via a deformable living hinge.

In one embodiment, the angle of the sole plate 122 can be continuously adjustable between a minimum bounce position and a maximum bounce position. In the illustrated embodiment, the sole plate 122 is adjustable to a finite number of positions between and including a minimum bounce position and a maximum bounce position. In the illustrated embodiment, the sole plate 122 is adjustable between three positions, a minimum bounce position, a medium bounce position, and a maximum bounce position. In other embodiments, the sole plate 122 may be adjustable between additional positions, which may include, for example, 4, 5, 6, 7, 8, 9, 10, etc. positions. The golf club head includes an adjustment member 148 configured to abut the body 118 of the golf club head 100 and the sole plate 122 of the golf club head 100. As illustrated in FIG. 7, the body 118 can include a rear void 154 configured to accept the adjustment member 148. The adjustment member 148 is configured to slide in a heel-toe direction within the void 154. The void 154 can also include a locating rail 150 to facilitate smooth and controlled translation of the adjustment member 148. The adjustment member 148 can include a locating relief 152 configured to slidably receive the locating rail 150. When the adjustment member 148 and sole plate 122 are in a maximum bounce position a majority of the sole plate 122 is located furthest from the body 118 of the golf club head 100. When the adjustment member 148 and sole plate 122 are in a minimum bounce position a majority of the sole plate 122 is located closest to the body 118 of the golf club head 100.

Figure 9:
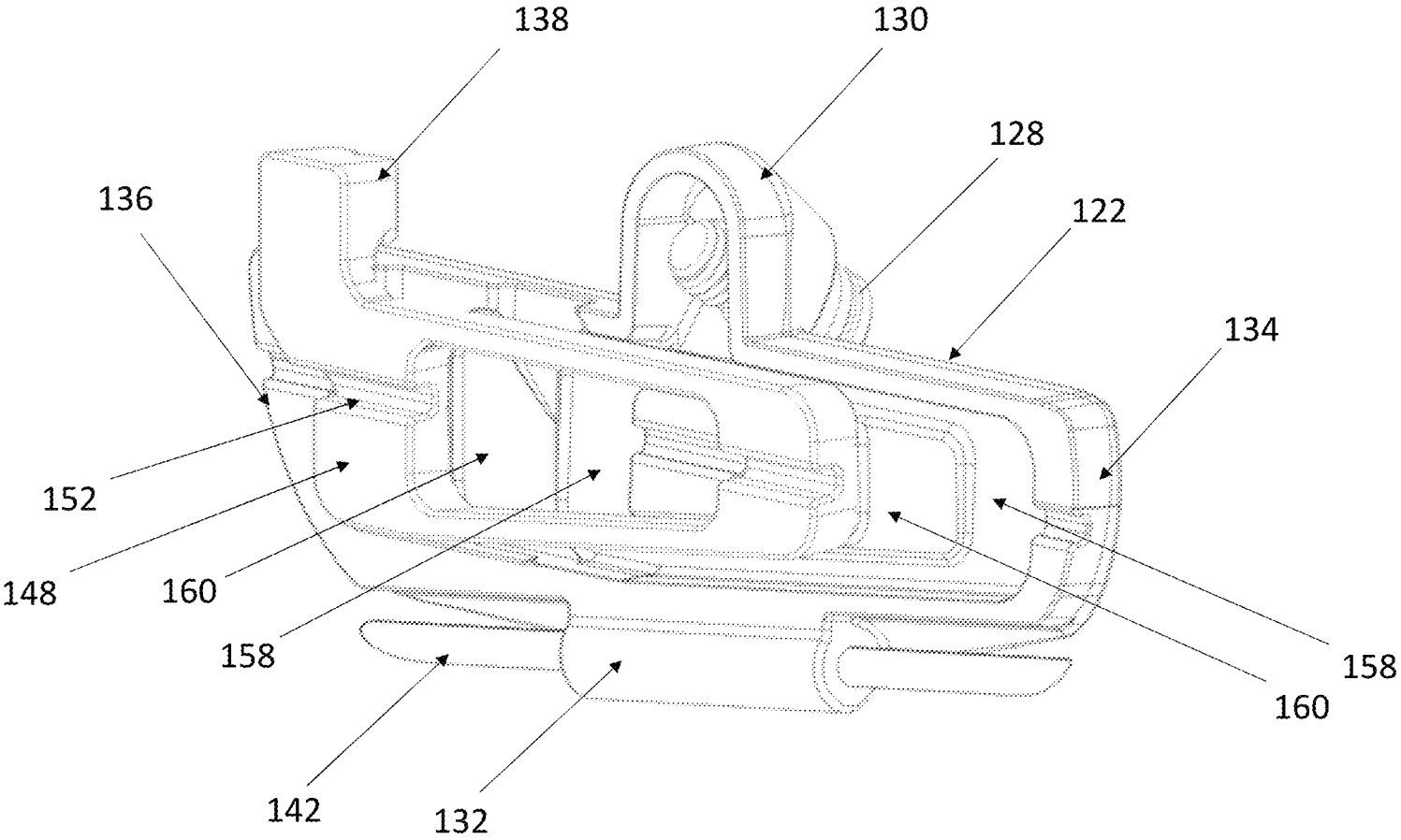
FIG. 9 illustrates a perspective view of the sole plate, adjustment member, pin, and sole plate retention member of the golf club head of FIG. 1.
Figure 10:
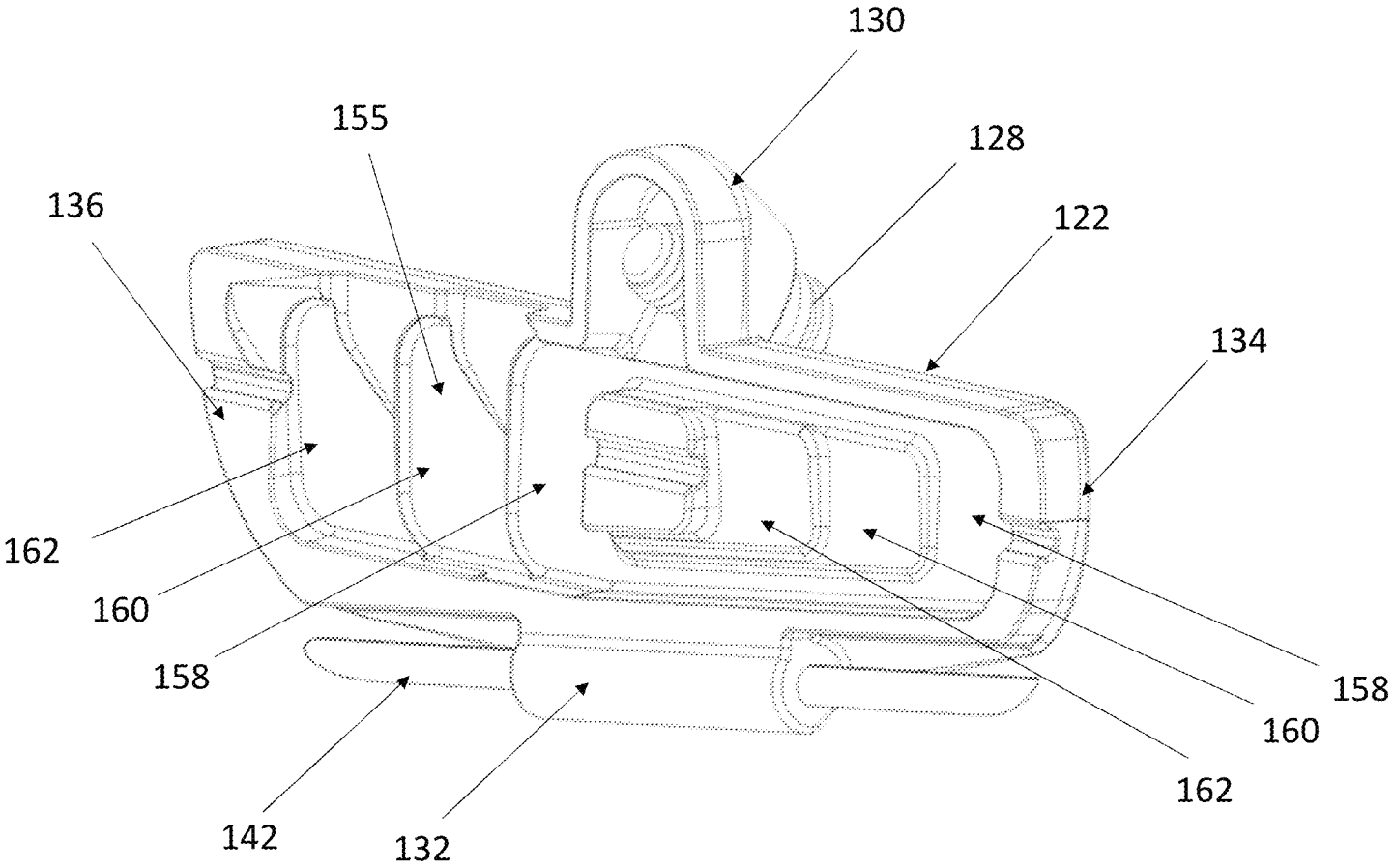
FIG. 10 illustrates a perspective view of the sole plate, pin, and sole plate retention member of the golf club head of FIG. 1.
Figure 11:
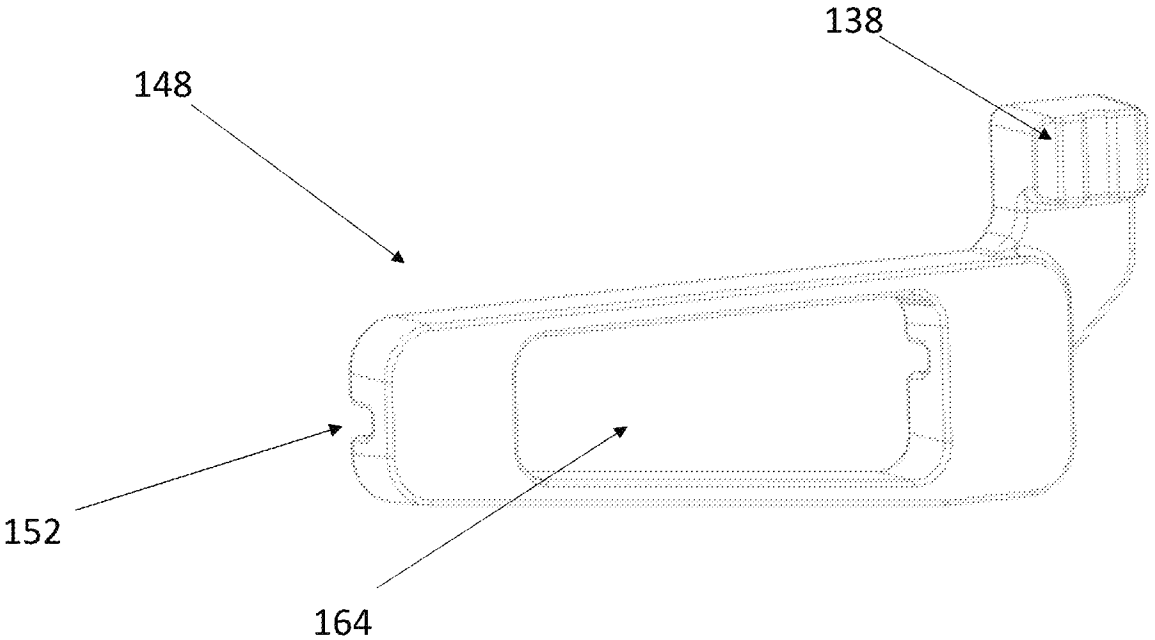
FIG. 11 illustrates a perspective view of the adjustment member of the golf club head of FIG. 1.

FIG. 9 illustrates a perspective view of the sole plate 122, adjustment member 148, pin 142, and sole plate retention member 128 of the golf club head 100 of FIG. 1. FIG. 10 illustrates a perspective view of the sole plate 122, pin 142, and sole plate retention member 128 of the golf club head 100 of FIG. 1. FIG. 11 illustrates a perspective view of the adjustment member 148 of the golf club head 100 of FIG. 1.

As illustrated in FIGS. 9 and 10, the sole plate 122 can include a recessed cavity area 155 configured to receive the adjustment member 148. The cavity area 155 is located opposite the sole plate sole surface 124 and is located adjacent the body 118 of the golf club head 100. The cavity area 155 can include a plurality of abutment surfaces 158, 160, 162 configured to abut the adjustment member 148. Each of the abutment surfaces 158, 160, 162 can have a different thickness such that placing the adjustment member 148 against each of the abutment surfaces 158, 160, 162 results in a different bounce position for the sole plate 122. The first abutment surface 158, located towards a plate heel portion 134, produces a minimum bounce position, the second abutment surface 160, located centrally, produces the medium bounce position, and the third abutment surface 162, located towards a plate toe portion 136, produces the maximum bounce position. The adjustment member 148 in FIG. 9 is located in the maximum bounce position. The adjustment member 148 can include an adjustment indicator 138 which may also be utilized to move the adjustment member 148 between bounce positions. Additionally, the adjustment member 148 can include an aperture 164 to reduce the mass of the adjustment member 148. In other embodiments, not illustrated, the abutment surfaces could be oriented such that the adjustment member translates towards the leading edge or topline when being moved from one bounce position to another rather than towards the heel or toe as described above.

As illustrated in FIGS. 8 and 8D, the golf club head 100 includes a plate retention member 128 configured to retain the sole plate 122 to the golf club head 100. The body 118 of the golf club head 100 includes a retention feature 144 configured to receive the plate retention member 128. In the illustrated embodiment, the plate retention member 128 is a threaded fastener and the retention feature 144 is a threaded bore. The sole plate 122 includes a retention bore 131 configured to receive the plate retention member 128. The bore 131 is preferably formed in the upper plate portion 130. The body 118 of the golf club head 100 can also include a sole plate relief 146 configured to receive the upper plate portion 130 in the various bounce positions. Additionally, in some embodiments and as illustrated in FIG. 8B, the golf club head 100 can include a washer 129 with a spherical surface abutting the head 127 of the retention member 128 and the sole plate 122. The spherical surface of the washer 129 allows the washer 129 to flushly abut the sole plate 122 through its various bounce positions as the retention member 128 maintains its axis of engagement with the body 118 of the golf club head 100.

In order to adjust the bounce position of the golf club head 100, the golfer will loosen the plate retention member 128, unlocking the sole plate 122 from the body 118, adjust the adjustment member 148 to the preferred bounce position, and tighten the plate retention member 128, locking the sole plate 122 to the body 118. In one embodiment, as illustrated in FIGS. 8 and 8D, the head 127 of the plate retention member 128 can be configured to abut a portion of the sole plate 122 as the plate retention member 128 is loosened, angling the sole plate 122 away from the body 118 of the golf club head 100, allowing the adjustment member 148 to slide to the desired position. In other embodiments, not illustrated, the adjustment member may be rotated into different bounce positions rather than translated.

In an additional embodiment, not illustrated, a deformable member may be incorporated between the sole plate and the body of the golf club head such that the effective bounce of the golf club head changes dynamically based on the normal force applied to the sole plate during impact with the turf. With such an embodiment, a hard turf environment would provide a higher normal force and deflect the sole plate further, resulting in a lower effective bounce. A lower effective bounce is preferably in a hard turf environment. A soft turf environment would provide a lower normal force and deflect the sole plate less far, resulting in a higher effective bounce. A higher effective bounce is preferable in a soft turf environment. This club would provide preferable effective bounce depending on the turf it is impacting.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. An iron type golf club head, comprising:

a body comprising:

a striking face;

a topline located at a top of said striking face;

a leading edge located at a bottom of said striking face;

a body sole surface extending rearward from said leading edge;

a hosel located at a heel side of said golf club head;

a toe side opposite said heel side;

a sole plate rotatably coupled to said body, wherein said sole plate comprises:

a cavity area adjacent said body;

a sole plate surface rearward from said cavity area;

an adjustment member located between said body and said sole plate, wherein said adjustment member comprises an elongated member having a locating relief configured to receive a locating rail on said body;

wherein said adjustment member is at least partially located within said cavity area of said sole plate;

wherein said adjustment member is adjustable between a maximum bounce position and a minimum bounce position;

wherein a majority of said sole plate is located furthest from said body when said adjustment member is located in said maximum bounce position and said majority of said sole plate is located closest to said body when said adjustment member is located in said minimum bounce position;

a plate retention member configured to selectively lock said sole plate to said body in a locked position, wherein said plate retention member comprises a threaded body, wherein said body comprises a threaded bore configured to receive said threaded body, and wherein rotation of said plate retention member forces said plate retention member between said locked position and an unlocked position;

wherein said sole plate rotates about a pivot axis;

wherein said pivot axis is located adjacent said leading edge; and a pin passing through said body and said sole plate, said pin located along said pivot axis;

wherein said sole plate comprises a first abutment surface and a second abutment surface;

wherein said adjustment member abuts said first abutment surface when said adjustment member is in said minimum bounce position and said second abutment surface when said adjustment member is in said maximum bounce position;

wherein said adjustment member is configured to slide between said maximum bounce position and said minimum bounce position when said plate retention member is in said unlocked position.

2. An iron type golf club head, comprising:

a body comprising:

a striking face;

a topline located at a top of said striking face;

a leading edge located at a bottom of said striking face;

a body sole surface extending rearward from said leading edge;

a hosel located at a heel side of said golf club head;

a toe side opposite said heel side;

a sole plate rotatably coupled to said body, wherein said sole plate comprises an adjustment member located between said body and said sole plate, wherein said adjustment member comprises an elongated member having a locating relief configured to receive a locating rail on said body;

wherein said adjustment member is adjustable between a maximum bounce position and a minimum bounce position;

wherein a majority of said sole plate is located furthest from said body when said adjustment member is located in said maximum bounce position and said majority of said sole plate is located closest to said body when said adjustment member is located in said minimum bounce position; and a plate retention member configured to selectively lock said sole plate to said body in a locked position, wherein said plate retention member comprises a threaded body, wherein said body comprises a threaded bore configured to receive said threaded body, and wherein rotation of said plate retention member forces said plate retention member between said locked position and an unlocked position;

wherein said adjustment member is configured to slide between said maximum bounce position and said minimum bounce position when said plate retention member is in said unlocked position.

3. The golf club head of claim 2, wherein said sole plate further comprises a cavity area adjacent said body and a sole plate surface rearward from said cavity area, wherein said adjustment member is at least partially located within said cavity area of said sole plate.

4. The golf club head of claim 2, wherein said sole plate rotates about a pivot axis, wherein said pivot axis is located adjacent said leading edge.

5. The golf club head of claim 2, wherein said sole plate comprises a first abutment surface and a second abutment surface, wherein said adjustment member abuts said first abutment surface when said adjustment member is in said minimum bounce position and said second abutment surface when said adjustment member is in said maximum bounce position.

6. The golf club head of claim 2, wherein said adjustment member further comprises an adjustment indicator, wherein said adjustment indicator comprises a tab connected to said elongated member, wherein said adjustment indicator is visible from an exterior of said golf club head, said adjustment indicator configured to indicate a position of said adjustment member.

7. The golf club head of claim 2, wherein said adjustment member is configured to slide along said locating rail on said body from said heel side towards said toe side of said golf club head.

8. The golf club head of claim 2, further comprising a washer residing between said plate retention member and said sole plate, said washer comprising a spherical surface, wherein said spherical surface abuts said plate retention member.

9. An iron type golf club head, comprising:

a body comprising:

a striking face;

a topline located at a top of said striking face;

a leading edge located at a bottom of said striking face;

a body sole surface extending rearward from said leading edge;

a hosel located at a heel side of said golf club head;

a toe side opposite said heel side;

a sole plate rotatably coupled to said body, wherein said sole plate comprises an adjustment member located between said body and said sole plate, wherein said adjustment member comprises an elongated member having a locating relief configured to receive a locating rail on said body;

wherein said adjustment member is adjustable between a maximum bounce position and a minimum bounce position;

wherein a majority of said sole plate is located furthest from said body when said adjustment member is located in said maximum bounce position and said majority of said sole plate is located closest to said body when said adjustment member is located in said minimum bounce position; and wherein said sole plate comprises a first abutment surface and a second abutment surface, wherein said adjustment member abuts said first abutment surface when said adjustment member is in said minimum bounce position and said second abutment surface when said adjustment member is in said maximum bounce position.

10. The golf club head of claim 9, wherein said sole plate further comprises a cavity area adjacent said body and a sole plate surface rearward from said cavity area, wherein said adjustment member is at least partially located within said cavity area of said sole plate.

11. The golf club head of claim 9, wherein said sole plate rotates about a pivot axis, wherein said pivot axis is located adjacent said leading edge.

12. The golf club head of claim 9, further comprising a plate retention member configured to selectively lock said sole plate to said body in a locked position, wherein said plate retention member comprises a threaded body, wherein said body comprises a threaded bore configured to receive said threaded body, wherein rotation of said plate retention member forces said plate retention member between said locked position and an unlocked position, and wherein said adjustment member is configured to slide between said maximum bounce position and said minimum bounce position when said plate retention member is in said unlocked position.

13. The golf club head of claim 9, wherein said adjustment member further comprises an adjustment indicator, wherein said adjustment indicator comprises a tab connected to said elongated member, wherein said adjustment indicator is visible from an exterior of said golf club head, said adjustment indicator configured to indicate a position of said adjustment member.

14. The golf club head of claim 12, further comprising a washer residing between said plate retention member and said sole plate, said washer comprising a spherical surface, wherein said spherical surface abuts said plate retention member.

* * * * *